US007456349B2

(12) United States Patent
Sugimoto et al.

(10) Patent No.: US 7,456,349 B2
(45) Date of Patent: Nov. 25, 2008

(54) ELECTRONIC KEYBOARD INSTRUMENT

(75) Inventors: Ryotaro Sugimoto, Shizuoka (JP); Takeshi Ando, Hamamatsu (JP); Seiji Abe, Hamamatsu (JP); Shinya Sakurada, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 11/488,519

(22) Filed: Jul. 18, 2006

(65) Prior Publication Data

US 2007/0017337 A1 Jan. 25, 2007

(30) Foreign Application Priority Data

Jul. 20, 2005 (JP) ..... 2005-209813

(51) Int. Cl.
*G10D 3/00* (2006.01)

(52) U.S. Cl. ..... 84/327; 108/114.11; 248/188.1; D6/480; 84/744

(58) Field of Classification Search ..... 84/743, 84/744, 327, 423 R; 108/144.11, 147, 158.12, 108/158.13, 145, 147.2, 42, 43, 49; 248/188, 248/188.1, 188.2, 163.1, 176.3, 27.1, 27.3; D06/480, 483, 48, 486
See application file for complete search history.

(56) References Cited

U.S. PATENT DOCUMENTS 761,468 A * 5/1904 Ford ..... 108/147.21
D262,501 S * 1/1982 Lenger, Jr. ..... D6/425
D282,030 S * 1/1986 Sottsass et al. ..... D6/422
D289,240 S * 4/1987 Sylvester et al. ..... D6/429
4,669,691 A * 6/1987 Solomon ..... 248/165
D372,818 S * 8/1996 Snell ..... D6/483
D400,027 S * 10/1998 Gongora et al. ..... D6/396
6,044,758 A * 4/2000 Drake ..... 100/43
D467,268 S * 12/2002 Nagele ..... D18/56
D477,931 S * 8/2003 Chang ..... D6/422
D479,778 S * 9/2003 Haney et al. ..... D6/511
D508,173 S * 8/2005 Guard et al. ..... D6/480
D510,821 S * 10/2005 Madison ..... D6/425
D512,249 S * 12/2005 Martin ..... D6/480
D530,939 S * 10/2006 Nakamura ..... D6/425
D532,221 S * 11/2006 Relling ..... D6/480

(Continued)

FOREIGN PATENT DOCUMENTS

JP 05-297865 A 11/1993

*Primary Examiner*—David S. Warren
(74) *Attorney, Agent, or Firm*—Rossi, Kimms & McDowell LLP

(57) ABSTRACT

Electronic keyboard instrument is provided with a leg section supporting thereon a keyboard in such a manner that the keyboard is located at a height falling within a range from 350 mm to 500 mm. Namely, the leg section supports thereon the keyboard at a suitable height that is substantially equal to an average height of ordinary low tables designed on the assumption that they are generally used when users are in a comfortable position. Namely, the "height falling within a range from 350 mm to 500 mm" is derived from survey results of heights of low tables. Thus, when the user sits in front of the keyboard instrument, the user can take a comfortable position as when sitting in front of a low table, and, even in such a comfortable position, the keyboard is located at a right height for playing. With such arrangements, the user is allowed, at any desired time, to readily enjoy playing the instrument in a natural playing posture.

8 Claims, 3 Drawing Sheets

U.S. PATENT DOCUMENTS

| | | | | | |
|---|---|---|---|---|---|
| D538,062 | S | * | 3/2007 | Chang | D6/422 |
| D557,927 | S | * | 12/2007 | Helm et al. | D6/397 |
| 2002/0189505 | A1 | * | 12/2002 | Markofer | 108/50.01 |
| 2004/0075372 | A1 | * | 4/2004 | Anderson | 312/208.1 |
| 2005/0056194 | A1 | * | 3/2005 | Danna | 108/143 |
| 2005/0121565 | A1 | * | 6/2005 | Johnson | 248/125.1 |
| 2006/0185564 | A1 | * | 8/2006 | Stengel et al. | 108/50.01 |

* cited by examiner

ELECTRONIC KEYBOARD INSTRUMENT

BACKGROUND OF THE INVENTION

The present invention relates generally to electronic keyboard instruments, such as electronic pianos, electronic organs and synthesizer keyboards, and more particularly to electronic keyboard instruments having leg sections for supporting thereon an instrument body section.

Heretofore, electronic keyboard instruments, such as electronic pianos, electronic organs and synthesizer keyboards, have been known which are equipped with a keyboard-type performance operator unit and which detect depression operation of a key on the operator unit to generate a predetermined performance signal for audible generation of a tone. Generally, in electronic pianos and electronic organs, an instrument body section, including the keyboard, is supported by a plurality of leg sections. The leg sections are generally adjusted to lengths such that a height of the keyboard surface (e.g., general plane formed by the upper surfaces of a plurality of white keys in their released position) from a floor surface, on which the keyboard instrument is placed, is about 735 mm that is an optimal height to allow a user or human player, sitting on a dedicated chair (i.e., chair dedicated to playing keyboard instruments), to play in a right playing posture; the 735 mm height is substantially equal to the height of the keyboard in natural or acoustic pianos or organs. Further, in many of the conventionally-known electronic keyboard instruments equipped with leg sections (i.e., "legged" electronic keyboard instruments), the instrument body section and leg sections are made of generally the same material and colored in generally the same color, so as to provide unity at least in outer appearance such that the keyboard instrument can suitably match the interior of a room where the keyboard instrument is placed. Among examples of such legged electronic keyboard instruments is one disclosed in Japanese Patent Application Laid-open Publication No. HEI-5-297865.

Further, with a view to allowing users to enjoy music, such as playing of a piano, with an increased ease, more and more small-size and easily-portable electronic keyboard instruments, such as portable keyboards and synthesizer keyboards, are being marketed nowadays. Because the primary advantageous feature of these electronic keyboard instruments is their portability, they are not equipped with leg sections supporting thereon the instrument body section. When these portable electronic keyboard instruments equipped with no leg section (i.e., "non-legged electronic keyboard instruments") are to be played, they are commonly placed on a desk or table, or on a dedicated stand as necessary.

Today, with diversification of life style, an increasing number of people want to enjoy music, such as playing of a piano, at home at any desired time in a comfortable seated position, e.g. sitting directly on a floor or on a sofa. However, with the aforementioned conventional legged electronic keyboard instruments, it is difficult for the user to play in a comfortable seated position, because the height of the keyboard is fixed on the assumption that the user plays the keyboard instrument sitting on a chair dedicated to playing of keyboard instruments and thus the keyboard is often not at a proper height when the user is in a comfortable seated position. To avoid such an inconvenience, it is conceivable to play a non-legged portable electronic keyboard instrument by placing it on a floor surface or low table; in such a case, however, there would be encountered various inconveniences due to the fact that all of users can not necessarily play their electronic keyboard instrument in a natural playing posture because all of them do not have tables of a same proper height in their houses, that it is cumbersome to bring and make ready the electronic keyboard instrument each time a performance is to be executed and then take away the keyboard instrument after the performance is over, and/or that the non-legged portable electronic keyboard instrument is generally inferior in design and outer appearance to the legged portable electronic keyboard instrument. Thus, there has been a demand for an improved electronic keyboard instrument having solved the aforementioned inconveniences in order to allow a greater number of people to enjoy music, such as playing of a piano, at home at any desired time in a comfortable position. However, such an improved electronic keyboard instrument has not been devised yet.

SUMMARY OF THE INVENTION

In view of the foregoing, it is an object of the present invention to provide an improved electronic keyboard instrument which allows a user to enjoy playing the instrument in a natural playing posture even when the user is in a comfortable position.

In order to accomplish the above-mentioned object, the present invention provides an improved electronic keyboard instrument, which comprises: a keyboard having a plurality of white and black keys; and a leg section that supports thereon the keyboard at a height falling within a range from 350 mm to 500 mm.

According to the present invention, the leg section supports thereon the keyboard in such a manner that the keyboard is located at a height falling within the range from 350 mm to 500 mm. Namely, the leg section supports thereon the keyboard at a suitable height that is substantially equal to an average height of ordinary low tables designed on the assumption that they are generally used when users are in a comfortable attitude or position. Namely, the "height falling within a range from 350 mm to 500 mm" is derived from survey results of heights of low tables. Thus, when the user sits in front of the electronic keyboard instrument of the invention, the user can take a comfortable position as when sitting in front of a low table, and, even in such a comfortable position, the keyboard is located at a right height for playing the instrument. With such arrangements, the user is allowed, at any desired time, to readily enjoy playing the instrument in a natural playing posture.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE INVENTION

Figure 1A:
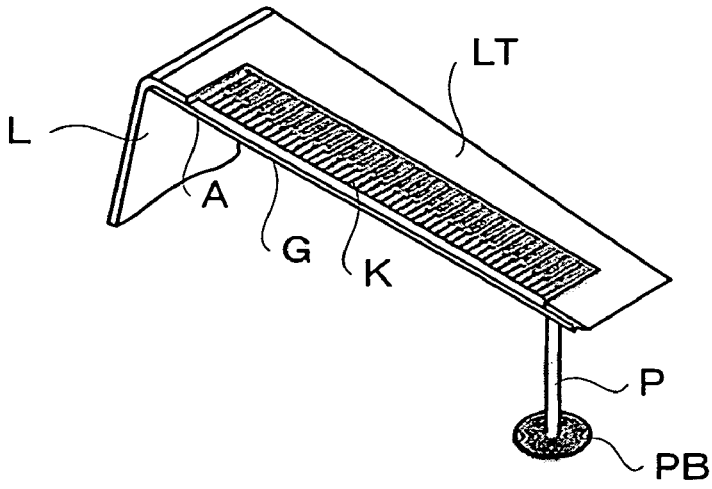
FIG. 1A is a perspective view showing an example general outer appearance and construction of an electronic keyboard instrument in accordance with an embodiment of the present invention.
Figure 1B:
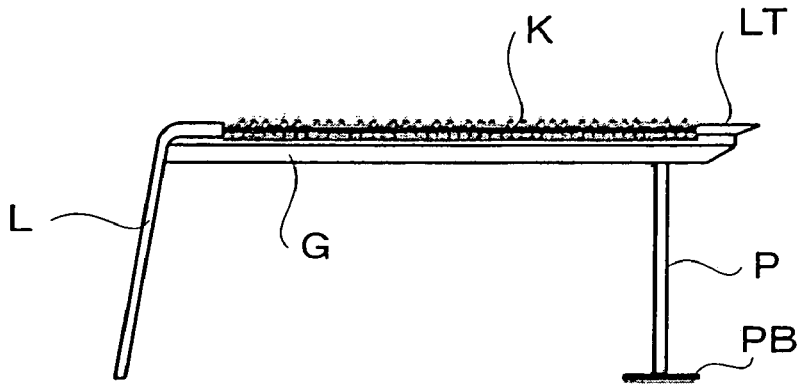
FIGS. 1B and 1C are a front view and side view, respectively, of the electronic keyboard instrument.
Figure 1C:
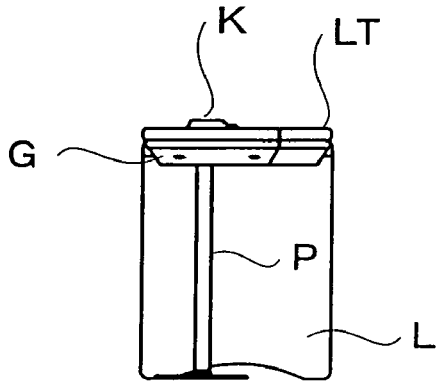

FIGS. 1A-1C show an example general construction of an electronic keyboard instrument in accordance with an embodiment of the present invention; more specifically, FIG. 1A is a perspective view showing an external appearance of the electronic keyboard instrument, and FIGS. 1B and 1C are a front view and side view, respectively, of the keyboard instrument.

The embodiment of the electronic keyboard instrument generally comprises an instrument base section LT formed by bending a single wood plate of a relatively great width into a substantial L shape (i.e., L-shaped bentwood plate), an instrument body section G, and a leg section P of a cylindrical bar shape having a lower end base PB having a greater surface area than a cross-sectional area of a body portion (i.e., portion other than the base PB) of the leg section P. The instrument body section G includes a keyboard K provided on its upper surface. The instrument base section LT, instrument body section G and leg section P are each provided as a unitized component, so that the electronic keyboard instrument can be assembled with ease. The instrument base section LT is a one-piece structure in the form of the bentwood plate having a smooth curved surface continuing from a surface of a top plate section (i.e., top plate surface), forming an upper surface of the electronic keyboard instrument to a surface of a side wall L that functions as another leg section L of the electronic keyboard instrument. The instrument base section LT functions also as an exterior of the electronic keyboard instrument. As viewed in plan, the top plate section of the instrument base section LT has a substantial trapezoidal shape so as to match the image of an acoustic grand piano; that is, the width (or depth) of the top plate surface gradually increases in a direction from the highest-pitch key to the lowest-pitch key of the keyboard K (i.e., in a leftward direction of FIG. 1A), namely, the width (or depth) of the top plate surface gradually decreases in a direction from the lowest-pitch key to the highest-pitch key of the keyboard K (i.e., in a rightward direction of FIG. 1A). Such arrangements not only facilitate assembly of the leg sections of the electronic keyboard instrument but also secure a stabilized posture of the leg sections and hence the entire keyboard instrument. Further, the bar-shaped leg section P adds to the stability by means of the base PB having a greater area.

Further, part of the top plate section is recessed concavely from its front edge toward its rear edge, and the instrument body section G is mounted on the underside of the top plate section in such a manner that only the keyboard K is exposed from the recessed portion A. In this way, the instant embodiment can afford not only a design- or appearance-related merit that the surface of the keyboard instrument as a whole can impart a flat and integral feeling, but also a practical merit that the instrument body section G can be protected from damage. More specifically, the instrument body section G includes, in addition to the keyboard K, a not-shown power supply, tone generator, amplifier, speaker, etc., as well as a multiplicity of electronic components that perform various control, such as: control for producing a tone by generating a predetermined performance signal in response to, for example, detection of depression of any one of the keys on the keyboard; control for producing a tone on the basis of a performance signal received from external equipment like a personal computer or other MIDI equipment; and control for transmitting a performance signal to the external equipment. The above-described arrangements employed in the instant embodiment can effectively protect the various components of the instrument body section G from dust, dirt, contamination, water staining, etc., to thereby prevent failure and malfunction of the instrument body section G. Because the instrument body section G is mounted on the underside of the top plate section from below the top plate section, mounting members, such as screws, are not exposed on the surface of the keyboard instrument, which can not only effectively prevent some object from being caught by the mounting members and preventing the screws from undesirably coming loose by contacting some object but also achieve a good outer appearance.

The leg section P is detachably attached to the underside or reverse side of the instrument body section G, at a predetermined position adjacent to an end surface of the body section G opposite from the other leg section L of the instrument base section LT, in such a manner that the leg section P can maintain the instrument body section G in stable condition and maintain the keyboard K in a horizontal posture in conjunction with the leg section L. The leg section L of the instrument base section LT is inclined relative to the top plate section so that, when the electronic keyboard instrument is in use, it extends in an inclined posture, rather than in an upright posture, relative to a floor surface, table surface or the like, while the leg section P is fixed to the instrument body section G substantially at a right angle to the top plate section so that, when the electronic keyboard instrument is in use, it extends substantially upright relative to a floor surface, table surface or the like. Namely, because the leg section L is a plate member of a relatively great width integrally formed with the top plate section and hence has a great mechanical strength, there is a small possibility of the leg section L being broken even though it is inclined relative to the top plate section and hence relative to a floor surface, table surface or the like. On the other hand, the leg section P, which does not necessarily have a great diameter and mechanical strength (it is in the form of a cylindrical bar of a small diameter as seen from the illustrated example), is preferably fixed to the top plate section at a right angle thereto so as to extend substantially upright when the keyboard instrument is in use. Because, if the leg section P is inclined relative to the top plate section, it will be supported on a floor surface, table surface or the like in an inclined posture, in which case it might be broken due to a weight acting downward on the leg section P. But, the leg section P may also be inclined relative to the top plate section if it has a sufficient mechanical strength.

To improve the appearance of the electronic keyboard instrument, it is desirable that as many cables and related components as possible be removed; for example, it is preferable that the power supply be in the form of a battery and the electronic keyboard instrument be connected with the external equipment, such as a personal computer or MIDI equipment, in a wireless manner. Further, in order to make the instrument body section G look more stylish for enhancement of the overall appearance of the electronic keyboard instrument, it is essential to reduce the thickness of the instrument body section G. For such a purpose, the tone generator, amplifier, etc. may be provided as components or devices separate from the instrument body section G, in which case MIDI signals may be transmitted from the instrument body section G to the separate devices so that tones are generated and sounded via these separate devices. In this way, there is accomplished the superior benefit that the power consumption by the instrument body section G can be significantly reduced and thus the instrument body section G can be driven for a long time even with the battery.

Preferably, one end of the instrument body section G, opposed to the inner surface of the side wall L, is formed into a smoothly-curved surface similar to the smoothly-curved inner surface of the portion of the base section LT where the base section LT is bent to provide the above-mentioned leg section L.

In the electronic keyboard instrument shown in FIGS. 1A-1C, the leg sections L and P each have a predetermined length appropriately adjusted such that the height of the keyboard K, i.e. height from a floor surface, table surface or the like up to the upper surface of the keyboard K (keyboard surface), falls within a range of 350 mm-500 mm. Namely, the two opposed leg sections L and P support thereon the instrument body section G so that the keyboard K is located at a proper height (350 mm-500 mm) to allow the user to play the electronic keyboard instrument in a natural playing posture in a comfortable seated position on a floor, chair, sofa or the like. Such a height to the keyboard surface, determined by the length of the leg sections L and P, is based on an average height of low tables actually on the market today. Namely, the inventor etc. surveyed ordinary low tables actually sold in furniture shops etc. as furniture to be placed in living rooms, and the survey results have shown that most of the low tables have any one of heights of 49, 48, 45, 43, 40, 39, 37 and 36 cm. Because the low tables are generally designed on the premise that they are generally used by users in a comfortable seated position, it may be understood that the above-mentioned height range of the low tables is an optimal range figured out, from the viewpoint of human engineering, with a view to allowing ordinary users to use the low tables in a comfortable seated position. In view of this, the height of the keyboard K in the electronic keyboard instrument of the present invention is set to the 350 mm-500 mm range similar to the optimal height range of the low tables, to allow the user to play the keyboard instrument in a natural playing posture in a comfortable seated position. Further, an actual electronic keyboard instrument was manufactured on the basis of the results of the aforementioned survey, as a result of which it has been shown that a 400 mm-450 mm range out of the 350 mm-500 mm range permits particularly comfortable playing of the keyboard instrument in a seated position both on a floor and on a sofa. For example, the "432 mm" length of the leg section L shown in FIG. 3B is among lengths that permit an optimal height range of the keyboard K for the most comfortable playing of the keyboard instrument.

Figure 2A:
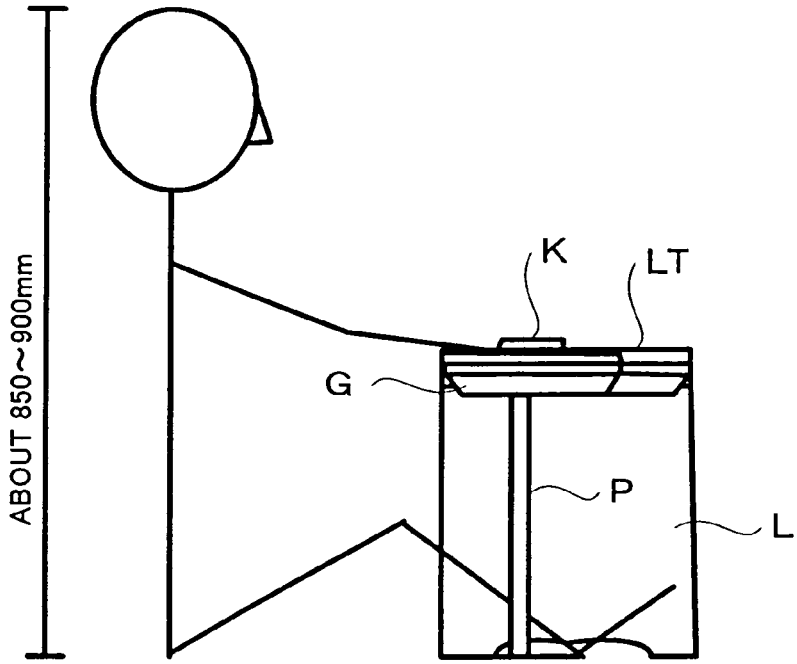
FIG. 2A is a conceptual diagram showing a user playing the electronic keyboard instrument of FIG. 1A in a comfortable position sitting directly on a floor.
Figure 2B:
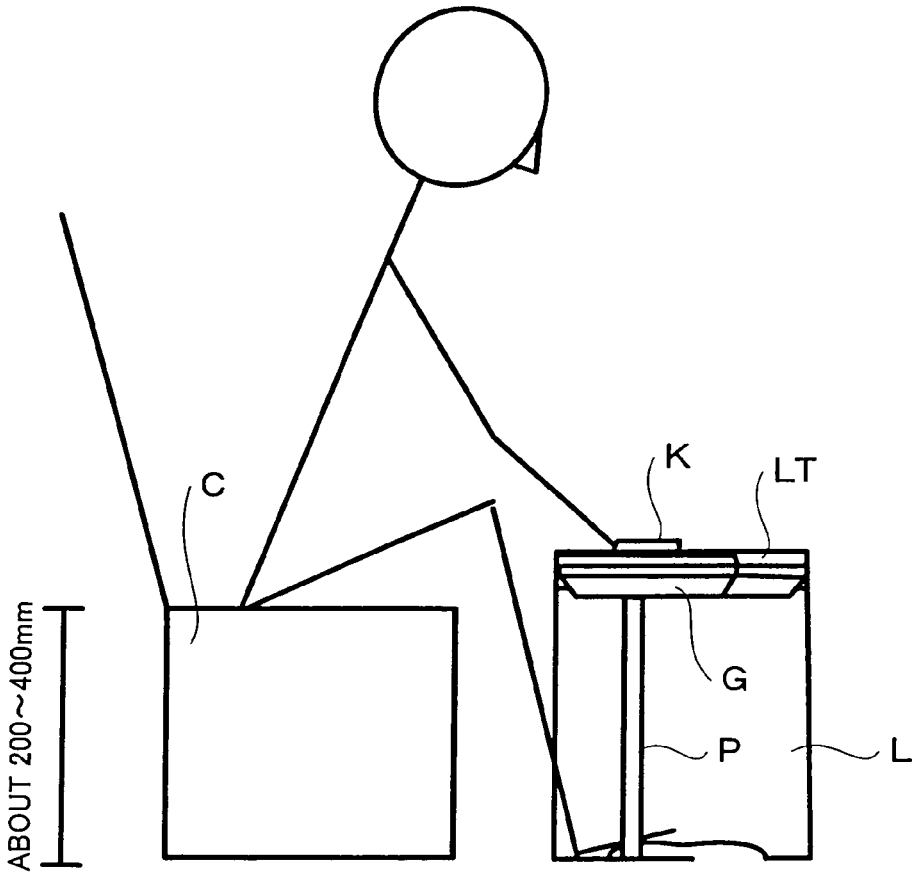
FIG. 2B is a schematic diagram showing the user playing the electronic keyboard instrument of FIG. 1A sitting on a chair having a small height.

FIGS. 2A and 2B show an example manner in which the electronic keyboard instrument of FIG. 1A is played, of which FIG. 2A shows the user playing the keyboard instrument sitting directly on a floor and FIG. 2B shows the user playing the keyboard instrument sitting on a chair or sofa having a small height (about 200 mm-400 mm). As seen from these figures, the user is allowed to play the keyboard instrument in a comfortable seated position and in a natural playing posture irrespective of whether the user is sitting directly on the floor or on the sofa of a small height in the range of about 200 mm-400 mm. Namely, in the illustrated example, the keyboard K is set at a height that was derived from the results of the survey of low table heights and that allows the user or human player to play the keyboard instrument in a natural playing posture in a most comfortable seated position. If the height of the keyboard K is set higher, the user has to take an unnatural playing posture with his or her arms raised higher than in the playing posture of FIG. 2A, in the case where the keyboard instrument is to be played by the user sitting on the floor. In such an unnatural playing posture, it tends to be difficult for the user to play the keyboard instrument. If, on the other hand, the height of the keyboard K is set lower, the user has to take an unnatural, bending-down playing posture more cramped than in the playing posture of FIG. 2B, in the case where the keyboard instrument is to be played by the user sitting on the sofa of a small height in the range of about 200 mm-400 mm. In such an unnatural, bending-down playing posture, it tends to be difficult for the user to play the keyboard instrument. Further, in playing the instrument in a seated position on the floor, it tends to be difficult for the user to take a more relaxed and comfortable position, e.g. putting and stretching his or her legs under the instrument body section G. Thus, in order to allow the user to play the keyboard instrument in a natural playing posture in a comfortable seated position, it is preferable that the length of the leg sections L and P be adjusted so that the height of the keyboard K (i.e., keyboard surface) falls in the 350 mm-500 mm range, more preferably in the 400 mm-450 mm range.

Figure 3A:
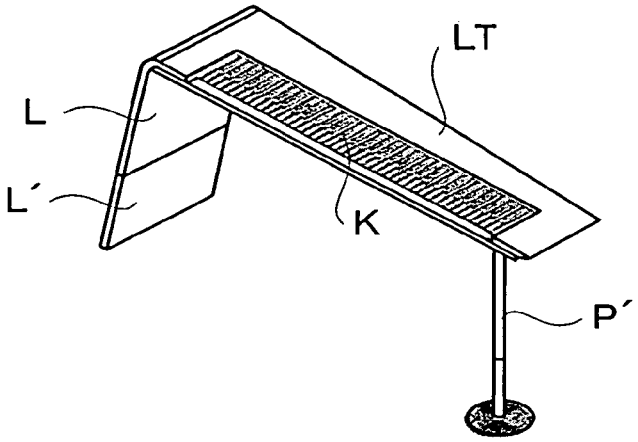
FIG. 3A is a perspective view explanatory of how the electronic keyboard instrument of FIG. 1A is played by the user sitting on a conventional chair dedicated to playing of keyboard instruments.
Figure 3B:
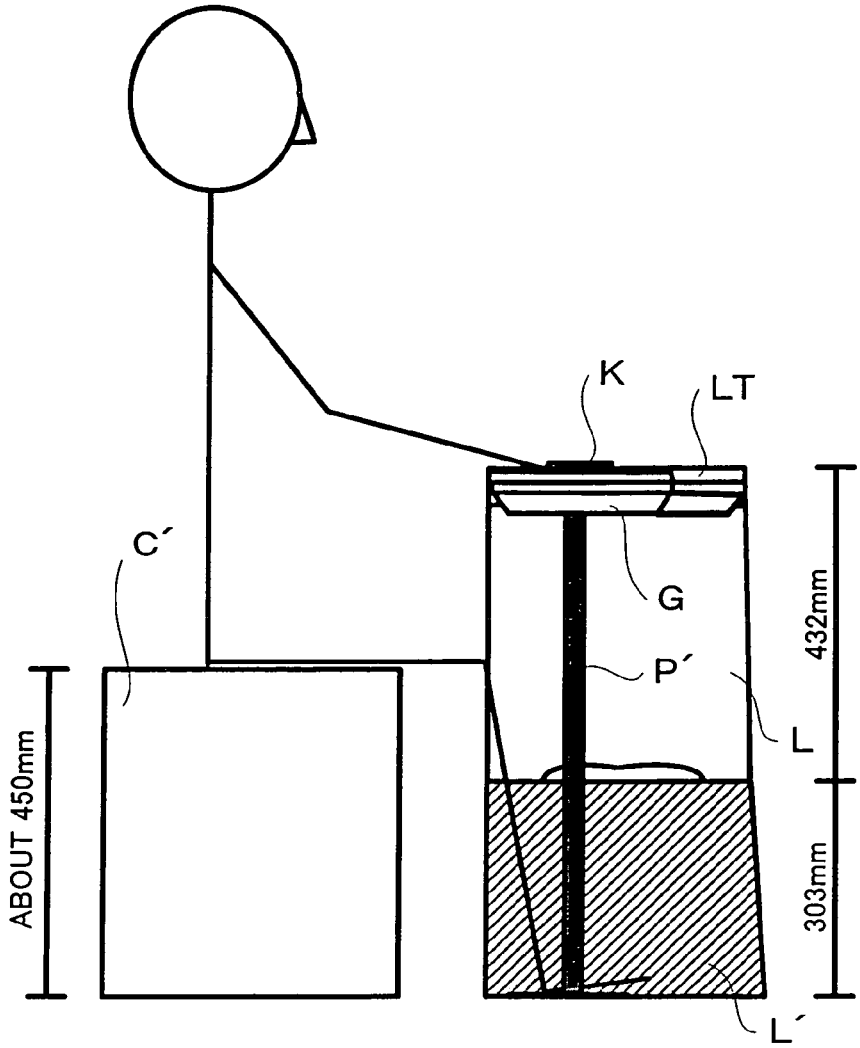
FIG. 3B is a schematic diagram showing how the electronic keyboard instrument of FIG. 3A is actually played.

FIGS. 3A and 3B are views explanatory of a manner in which the electronic keyboard instrument of FIG. 1A is played by the human player or user sitting on a conventional chair dedicated to playing of keyboard instruments, of which FIG. 3A is a perspective view showing an external appearance of the electronic keyboard instrument and FIG. 3B is a view showing how the user plays the electronic keyboard instrument sitting on the dedicated chair C'. Needless to say, even where the user plays the electronic keyboard instrument sitting on the dedicated chair C', arrangements have to be made for allowing the human player to play the keyboard instrument in a natural playing posture. Therefore, the electronic keyboard instrument of the present invention is constructed in such a manner that an additional leg L' can be attached to the leg section L and a replacing leg P' can replace the leg section P. Namely, in the electronic keyboard instrument of the present invention, the additional leg L' and replacing leg P' can be used in order to adjust the keyboard K to an optimal height for allowing the human player to play the keyboard instrument in a natural playing posture in a seated position on the dedicated chair C' having a height of about 450 mm. FIGS. 3A and 3B show the additional leg L' having a 303 mm length attached to one of the leg sections L and the replacing leg P' having about 735 mm length used in place of the other leg section P.

Namely, the electronic keyboard instrument according to the preferred embodiment of the present invention is a legged electronic keyboard instrument which has the leg sections L and P that support thereon the instrument body section G having the keyboard K and that have a length adjusted so that the keyboard K (specifically, keyboard surface) has a height falling within the 350 mm-500 mm range. With such arrangements, the user or human player is allowed to play the electronic keyboard instrument in a natural playing posture even in a comfortable seated position. Further, in the electronic keyboard instrument according to the preferred embodiment of the present invention, the height of the keyboard K is adjustable by the additional leg L' being attached to the leg section L and the replacing leg P' replacing the leg section P. In this way, the electronic keyboard instrument of the invention can be played by the user in a natural, proper playing posture even in a seated position on a conventional chair dedicated to playing of acoustic pianos and the like.

Furthermore, because the electronic keyboard instrument according to the preferred embodiment is designed to have a smooth curved surface as viewed from the front of the keyboard and flat integral (continuous) surface as viewed from above the keyboard and can appropriately match the interior of a room where the instrument is placed, it never impart an incompatible feeling even where it is near-permanently placed in the room like a low table. Thus, the user can enjoy playing the electronic keyboard instrument at any desired time without having to put the keyboard instrument in and out of the room.

Whereas the embodiment has been described above in relation to the case where the instrument base section LT is constructed as a one-piece structure in the form of the bent-wood plate having a smooth curved surface continuing from the upper surface of the instrument to one of the one leg section L and where the other leg section P is in the form of a cylindrical bar, the present invention is not so limited.

Note that the instrument base section LT and leg section P may be formed of any of various materials, such as wood, resin and metal; the material of the instrument base section LT and the material of the leg section P may be either the same or different from each other.

Whereas the embodiment has been described as using the additional leg L' and replacing leg P' to allow the user to play the keyboard instrument sitting on the dedicated chair, both the additional leg L' may be added to each of the left and right leg sections or the replacing leg P' may replace each of the left and right leg sections. In the case where the additional leg L' is added to the existing leg section, a connecting portion between the leg section and additional leg may be of any desired construction. Needless to say, arrangements may be made to allow the height of the keyboard surface to be adjusted to be higher than about 735 mm so that the human player can play the keyboard instrument in a natural playing posture even in a standing (or non-seated) position. Furthermore, the leg sections may be constructed as height-variable leg sections without being limited to the height adjustment using the additional or replacing leg.

Further, there may be provided a low-height chair dedicated only to the electronic keyboard instrument of the invention, i.e. a chair having generally the same height as a seat surface of a sofa.

Plate formed of glass, resin or the like may be placed on the body section of the electronic keyboard instrument so that the electronic keyboard instrument can be used as a low table.

There may also be provided an openable/closeable lid, formed of the same material as the instrument base section LT, for covering only the keyboard K.

Also note that the leg section L or P may comprises a combination of a plurality of short leg members. In another alternatively, the electronic keyboard instrument of the invention may be of a type equipped with only one leg section.

With the arrangement that one or more leg sections support thereon the keyboard at a height falling within the range from 350 mm to 500 mm, the present invention can afford the superior benefit that the user is allowed to enjoy playing the keyboard instrument in a natural playing posture even when the user is in a comfortable position.

What is claimed is:

1. An electronic keyboard instrument comprising:

a keyboard having a plurality of white and black keys;

a substantially L-shaped base section having a top section configured to support the keys while providing access to the keys, and a first leg section integral with the top section; and a second leg section mounted to the top section to support the L-shaped base section so that the keyboard is supported at a level, wherein the first and second leg sections are configured so that the keys are at a predetermined height, wherein the top section is plate shaped having a cutout configured to the keyboard, and wherein the keyboard has an instrument body section that is mounted to the underside of the top section so that the white and black keys are exposed.

2. The electronic keyboard instrument as claimed in claim 1, further including a leg extension connectable to the first leg section, and wherein the second leg section is adjustable in length so that the keys at a height of about 735 mm.

3. The electronic keyboard instrument as claimed in claim 1, wherein the first leg section is plate shaped.

4. The electronic keyboard instrument as claimed in claim 3, wherein the first leg section extending continuously from the top section at an angle from the top section.

5. The electronic keyboard instrument as claimed in claim 4, wherein is bar shaped.

6. The electronic keyboard instrument as claimed in claim 5, wherein the second leg section has a lower end base for more stable support.

7. The electronic keyboard instrument as claimed in claim 3, wherein the top section has a generally trapezoidal shape, and wherein a wider end of the top section has the first leg extending at an angle.

8. The electronic keyboard instrument as claimed in claim 1, wherein the first and second leg sections position the keys at a height falling within a range from 350 mm to 500 mm.

* * * * *